United States Patent [19]

Amtmann et al.

[11] 4,317,999

[45] Mar. 2, 1982

[54] X-RAY DIAGNOSTIC GENERATOR COMPRISING SWITCHING MEANS FOR SWITCHING-ON AND -OFF THE HIGH VOLTAGE TRANSFORMER

[75] Inventors: Heribert Amtmann, Langensendelbach; Klaus Baeker, Uttenreuth, both of Fed. Rep. of Germany

[73] Assignee: Siemens Aktiengesellschaft, Berlin & Munich, Fed. Rep. of Germany

[21] Appl. No.: 100,849

[22] Filed: Dec. 6, 1979

[30] Foreign Application Priority Data

Jan. 9, 1979 [DE] Fed. Rep. of Germany ..... 2900623

[51] Int. Cl.[3] ..... H05G 1/30

[52] U.S. Cl. ..... 250/413

[58] Field of Search ..... 250/401, 402, 413, 414, 250/421

[56] References Cited

U.S. PATENT DOCUMENTS 3,130,312 4/1964 Craig ..... 250/413

4,208,584 6/1980 Vogler et al. ..... 250/413

OTHER PUBLICATIONS

Küchler, Rudolf, *Die Transformatoren,* Springer-Verlag Publisher, 1966, pp. 53–57.

*Primary Examiner*—Alfred E. Smith

*Assistant Examiner*—Janice A. Howell

*Attorney, Agent, or Firm*—Hill, Van Santen, Steadman, Chiara & Simpson

[57] ABSTRACT

In an exemplary embodiment, a circuit arrangement is present for the purpose of storage of information which corresponds to the switch-off phase angle of the supply voltage and for the purpose of switching-on at a phase position of the supply voltage which is equal to the respectively stored phase angle. In order to take into account the delay time between a switch-on signal and the actual switching-on of the high voltage transformer, two time systems are present, operating in relative displacement by the amount of the delay time, which time systems recognize the respective phase position of the supply voltage and cooperate with the memory as well as with a comparator, where the phase position present at the switch-off time is stored taking into account the delay time. The comparator delivers enabling signals for the switching-on of the high voltage transformer when the supply voltage reaches the switch-off-phase position which is pre-displaced by the amount of the delay time.

3 Claims, 1 Drawing Figure

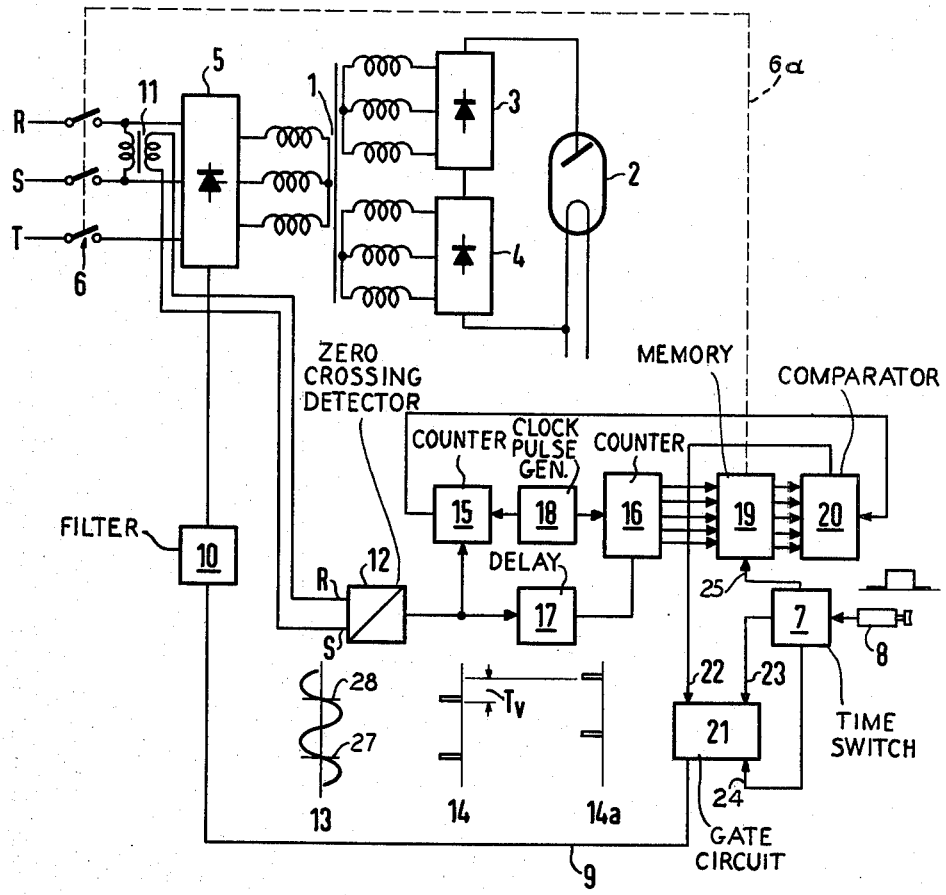
R
S
T
6
11
5
1
3
4
2
6a
ZERO CROSSING DETECTOR
MEMORY
COMPARATOR
COUNTER
CLOCK PULSE GEN.
COUNTER
15
18
16
19
20
FILTER
10
12
R
S
DELAY
17
25
7
8
22
23
28
27
Tv
21
TIME SWITCH
24
13
14
14a
GATE CIRCUIT
9

X-RAY DIAGNOSTIC GENERATOR COMPRISING SWITCHING MEANS FOR SWITCHING-ON AND -OFF THE HIGH VOLTAGE TRANSFORMER

BACKGROUND OF THE INVENTION

The invention relates to an x-ray diagnostic generator comprising switching means for switching-on and -off the high voltage transformers at predetermined times.

In switching on a high voltage transformer, after approximately half of the time period of the supply waveform (i.e. the duration of a half cycle pulse), a magnetization peak current occurs which can amount to a multiple of the steady state magnetization current. The most unfavorable instance is provided when the switch-on operation is effected when a phase passes through zero. A high switch-on current pulse (or surge), however, due to the inner voltage drop in the x-ray diagnostic generator, leads to a voltage intrusion (penetration) which is undesirable.

The switch-on current surge can be kept low if always the positive or negative voltage maximum, in the case of a three phase generator of one of the three phases, is selected as the fixed switch-on and -off time. However, this has the disadvantage that only switch-on times of integral multiples of the mains period duration can be realized, and the shortest switching time is restricted to the period duration.

SUMMARY OF THE INVENTION

The object of the invention resides in designing an x-ray diagnostic generator of the type initially cited in such a manner that the switch-on current surge is restricted (or limited) to a minimum also in the case of switching-on and -off at other times than at the phase maximum.

In accordance with the invention, this object is solved in that a circuit arrangement for storing of information is present which corresponds to the switch-off phase angle of the supply voltage, and which effects the switching-on in the case of a phase position of the supply voltage which is equal to the respectively stored phase angle. In the inventive x-ray diagnostic generator, the switch-off phase angle of a preceding radiographic exposure or fluoroscopic examination is always equal to the switch-on phase angle of the next radiographic exposure or fluoroscopy interval. Thus, it is always guaranteed that the remanance remaining from the preceding radiographic exposure or fluoroscopy counteracts (or acts counter to) the induced flow, and that, even in the case of switching-on in the passage through zero of a phase, only a small current surge and hence only a small voltage intrusion occurs.

In the case of x-ray diagnostic generators, a delay time occurs virtually always between the switch-on signal and the actual switching-on of the high voltage transformer. This delay time can be determined e.g., by a filter which is series connected to the switch for the high voltage transformer, by means of which filter interferences are filtered out. According to an embodiment of the invention, for the purpose of exact switching-on at the same phase angle at which switching-off was previously carried out, it is proposed that two time systems be provided which operate displaced (or offset) relative to one another by the amount of the delay time, which time systems recognize the respective phase position of the supply voltage and which cooperate with a memory and comparator, where the phase position present in the switch-off time is stored, taking into account the delay time, whereby the comparator delivers a release (enabling) signal for the switching-on of the high voltage transformer when the supply voltage reaches the switch off-phase position which has been pre-displaced by the amount of the delay time.

Details and embodiments of the invention shall be apparent from the following description of an exemplarly embodiment on the basis of the drawing in conjunction with the subclaims; and other objects, features and advantages will be apparent from this detailed disclosure and from the appended claims.

BRIEF DESCRIPTION OF THE DRAWINGS

The single FIGURE is an electric circuit diagram for illustrating an exemplary embodiment in accordance with the present invention.

DETAILED DESCRIPTION

In the drawing a high voltage transformer 1 is illustrated which supplies an x-ray tube 2 via two series-connected high voltage rectifiers 3, 4. The primary windings of the high voltage transformer 1 are capable of connection to the three-phase mains via a thyristor switch 5 and a main switch 6. The main switch 6 is generally closed. The heating of the x-ray tube 2 proceeds in a known fashion via a non-illustrated filament transformer.

The determination of the switch-on time of the x-ray tube 2 and thus of the high voltage transformer 1 proceeds in the example by means of a time switch 7 to which a radiographic trigger device 8 is allocated. The switch-on signal is connected to a line 9 and controls the thyristor switch 5 via a filter 10. The filter 10 has the task of filtering out interferences on the line 9. Subsequent to occurrence of a switch-on signal on the line 9, a time Tv elapses which is composed of the filter time and the precontact time of the thyristor switch 5, until the high voltage transformer 1 is actually switched on.

Between the phases R and S, via a single phase transformer 11, a voltage is tapped which is supplied to a sine waveform to digital converter 12. The converter 12, in the case of every positive passage through zero of the voltage between the phases R and S, corresponding to the waveform 13, produces at its output a narrow needle pulse corresponding to waveform 14. The needle pulses 14 reset a first counter 15 directly and a second counter 16 via a delay element 17 (having an output waveform 14*a*). The delay time of the delay element 17 is Tv; i.e., the delay time with which the circuit of the thyristor switch 5 is actuated. The counters 15 and 16 are synchronously operated by a clock pulse generator 18. A memory 19 serves the purpose of storing the counter reading of the counter 16 upon termination of a fluoroscopy examination or a radiographic exposure. A comparator 20 compares, in each instance, the stored value with the reading of the counter 15 and, in the case of equality, generates needle pulse which it supplies to the input 22 of gate circuit 21. If the gate 21 has at its input 23 a high enabling signal from the time switch 7 which indicates the commencement of a radiographic exposure, it effects the switching-on of the high voltage transformer 1 when a pulse of the comparator 20 occurs at its input 22.

The respective counts of the counters 15 and 16 correspond to the respective phase angle of the mains voltage. The count of the counter 16 as compared with the count of the counter 15 is here chronologically- (or time-) delayed by the delay time Tv. If a radiographic exposure is terminated, the reading of the counter 16 is taken over into the memory 19. The contents of the memory 19 accordingly correspond. taking into account Tv, to the phase angle at which the high voltage transformer 1 has been switched off. If subsequently the high voltage transformer 1 is to be switched on for a repeated x-ray exposure, the exposure trigger device 8 is actuated and a signal is supplied to the input 23 of the gate circuit 21. To the input 22, a signal is supplied by the comparator 20, which signal is dependent upon the switch-off phase angle and upon the delay time Tv, for the comparator 20 compares the contents of the memory 19 with the contents of the counter 15, and always delivers an output pulse when both contents are equal. Therefore, a signal occurs at the input 22 earlier by the time Tv than it should actually occur due to the switch-off-phase angle of the preceding switch-off operation. The gate circuit 21 then delivers a switch-on signal via 9 which is again delayed by the filter 10 and which, at the correct time; i.e., at the same phase angle at which the preceding exposure has been terminated, effects the switching-on of the high voltage transformer 1.

The initial switching-on can proceed at a random time, whereby a one-time voltage intrusion following the switching-on must be tolerated. However, it is also possible, pursuant to closing the main switch 6, to provide the memory 19 with information which effects the initial switching on at a maximum of the phase T, such as is indicated by the broken line 6*a*.

The resolution within which the switch-off phase angle is retained and the switch-on phase angle is established is dependent upon the frequency of the clock pulse generator 18. The achievable precision depends, among other things, also upon the width of the reset pulses for the counters 15, 16. In order to adapt the delay time Tv to ageing processes, said delay time can be adjustable in the delay member 17.

In the exemplary embodiment, the two counters 15, 16, together with the clock pulse generator 18 and the delay circuit 17, form two time systems operating in relative displacement by the delay time Tv, which recognize the respective phase position of the supply voltage, and which cooperate with the memory 19 as well as the comparator 20 in such a manner that the phase position present at the switch-off time is stored taking Tv into account. The output pulse signals of the comparator 20 are dependent upon the phase position at the switch-off time as well as upon the delay time.

By way of summary, it is apparent that, in the described x-ray diagnostic generator, the switch-on current peaks and voltage intrusions are reduced to a non-harmful level without a chronological restriction of the radiographic operation. The described circuit is also suitable for switching-on after a previously carried out fluoroscopy. Successive switching operations are phased-in with the aid of a logic circuit in such a fashion that the random switch-off phase angle of the preceding photographic exposure becomes equal to the switch-on phase angle of the following radiographic exposure. The remanance is here counter-directed to the induced flow, as a consequence of which the described decrease of switch-on current peaks is effected.

It will be apparent that many modifications and variations may be effected without departing from the scope of the novel concepts and teachings of the present invention.

Supplementary Discussion

Momentary actuation of trigger 8 may generate a logical one output signal from the terminal of time switch 7 which is connected to input 23 of gate circuit 21 which signal has a time duration at a high or logical one level corresponding to the period between positive-going zero crossings of waveform 13 (i.e., the time interval between zero crossings 27 and 28). The logical one signal at input 23 of gate circuit 21 may enable a logical AND gate of circuit 21 so that the next turn-on pulse from comparator 20 is transmitted by the AND gate to set a flip-flop of circuit 21, and thus to place output 9 in the logical one condition. When the time circuit 7 signals at line 24 that an exposure is to be terminated )because a predetermined dosage has been applied as measured behind the patient, this resets the flip-flop and after the delay of filter 10, turns off the supply to the primary of transformer 1. A companion pulse signal from time switch 7 may be supplied to control input 25 of memory circuit 19.

In placing the system in operating readiness, the closure of main switch 6 may also close a contact in the memory 19 (e.g. via a mechanical coupling 6*a*) so that the memory 19 stores a binary coded number at the closure of contacts 6 which represents the delay required for switching on of thyristor switch 6 at a point in time corresponding to a maximum of the phase T (to keep the initial exposure switch-on current surge low as explained herein in the section headed Background of the Invention).

With or without the coupling 6*a*, the first turn-off command from time switch 7 may be supplied to input 25 of the memory circuit 19 so as to cause the count value of counter 16 to be stored in memory 19 for controlling the following turn-on operation.

The converter or zero crossing detector 12 may be a conventional circuit such as is well known in the art. For example, the waveform 13 may be converted to a corresponding rectangular waveform and differentiated, so that the positive-going pulses after separation by means of a diode provide the waveform 14 with pulses coincident with the positive-going zero crossings such as 27 and 28.

The counters 15 and 16 may be resettable binary counters with a count capacity exceeding the number of pulses of each pulse train supplied from generator 18 in a complete cycle of the supply waveform 13. The memory 19 may comprise a number of register stages so as to receive the maximum count value of counter 16 in parallel, and may have its stages coupled with respective stages of counter 16 via a transfer gate circuit which is actuated by the turn-off waveform at control input 25 such that the resultant stored turn-off count value will thereafter minimize the turn-on current surge in the transformer at the start of the next exposure.

Where the rate of the pulse trains from the clock pulse generator 18 is such that the peak of the phase T follows a zero crossing such as 27 of waveform 13 by N counts, then at closure of main switch 6, the number N plus the count corresponding to Tv in binary form is loaded from a permanent register into the stages of a memory register of memory 19 whose state is to be compared with that of counter 15. Thus if trigger 8 is thereafter actuated, the AND gate of circuit 21 will be enabled, and the next coincidence between the value N plus Tv in memory 19 and the count (N plus Tv) in counter 15 produces a trigger pulse from comparator 20 which sets the flip of gate circuit 21.

With the turn-off signal at input 25, the aforementioned memory register stages of memory 19 are first reset and then immediately set to the value instantaneously in counter 16. Similarly at each turn off the previously stored turn-off count value is erased, and the instantaneous value of counter 16 then transferred into memory 19. Such action is similar to that in a multiple parallel stage shift register wherein the binary value stored in the stages of the memory register of memory 19 (corresponding to one shift register position) is first simultaneously shifted out therefrom, and then the respective digit values of a new multiple digit binary number are simultaneously transferred in (i.e. from counter 16) during the same shift operation and in response to a single shift pulse (i.e. at 25).

I claim as my invention:

1. An x-ray diagnostic generator comprising switching means for switching-on and -off of a high voltage transformer at predetermined times, characterized by a switching arrangement (12 through 21) for the purpose of storage of information which corresponds to the switch-off phase angle of the supply voltage, and for the purpose of switching-on at a phase position of the supply voltage which is equal to the respectively stored phase angle.

2. An x-ray diagnostic generator according to claim 1, wherein a delay time elapses between a switch-on signal and the actual switching-on of the high voltage transformer, characterized in that said switching arrangement comprises time system means (15 through 18) operating in relative displacement by the amount of the delay time, said time system means recognizing the respective phase position of the supply voltage, and said switching arrangement further comprising a memory (19) and a comparator (20) coupled with said time system means and with each other such that the phase position present at the switch-off time is stored in said memory taking into account the delay time, and such that the comparator (20) delivers an enabling signal for the switching-on of the high voltage transformer when the supply voltage reaches the switch-off-phase position pre-displaced by the amount of the delay time.

3. An x-ray diagnostic generator according to claim 2, characterized in that said time system means comprises respective time systems (15 through 18) including first and second counters (15, 16), which count synchronously, and reset signal means (12) coupled with said first counter (15) for supplying reset signals thereto such that said first counter (15) is always reset upon reaching a predetermined phase position of the supply voltage, and said second counter (16) being reset by the reset signals of the first counter (15) which are delayed by the amount of the delay time (Tv), said memory (19) being connected to the second counter (16) for the storage of its count value at the switch-off time of the high voltage transformer, and that the comparator (20) being connected to the memory (19) and to the first counter (15) so as to deliver an output pulse when the stored count value from the second counter and the count value of the first counter (15) are equal.

* * * * *